US010549942B2

(12) United States Patent
Le Rigoleur

(10) Patent No.: US 10,549,942 B2
(45) Date of Patent: Feb. 4, 2020

(54) HAND-HELD HANDLE DISPENSER

(71) Applicant: Neopost Technologies, Bagneux (FR)

(72) Inventor: Yann Le Rigoleur, Antony (FR)

(73) Assignee: NEOPOST TECHNOLOGIES, Bagneux (FR)

( * ) Notice: Subject to any disclaimer, the term of this patent is extended or adjusted under 35 U.S.C. 154(b) by 94 days.

(21) Appl. No.: 15/746,099

(22) PCT Filed: Jul. 20, 2015

(86) PCT No.: PCT/EP2015/066581
§ 371 (c)(1),
(2) Date: Jan. 19, 2018

(87) PCT Pub. No.: WO2017/012652
PCT Pub. Date: Jan. 26, 2017

(65) Prior Publication Data

US 2018/0215569 A1 Aug. 2, 2018

(51) Int. Cl.
*B65H 35/00* (2006.01)
*B65B 51/06* (2006.01)
*B65B 61/14* (2006.01)

(52) U.S. Cl.
CPC ..... *B65H 35/004* (2013.01); *B65B 51/06* (2013.01); *B65B 61/14* (2013.01);
(Continued)

(58) Field of Classification Search
CPC ..... B65H 35/0026; B65H 35/0033; B65H 35/004; B65H 35/0086; B65H 2301/5154;
(Continued)

(56) References Cited

U.S. PATENT DOCUMENTS 3,031,359 A 4/1962 Blank et al.
4,028,865 A 6/1977 Loveland et al.
(Continued)

FOREIGN PATENT DOCUMENTS

EP 0 628 483 A1 12/1994
EP 2 902 352 A1 8/2015
(Continued)

OTHER PUBLICATIONS

European Search Report, dated Mar. 17, 2014, for European Application No. 14 30 5012, 2 pages.
(Continued)

*Primary Examiner* — Mark A Osele
(74) *Attorney, Agent, or Firm* — Cozen O'Connor

(57) ABSTRACT

A hand-held handle dispenser comprising: a main frame (12) having a handle (14), an adhesive tape roll (16) provided on a rear side of the main frame for delivering an adhesive tape, an application element (18) provided on the front side of the main frame for applying the adhesive tape onto a parcel and a cutting blade (20) for cutting the adhesive tape, and further comprising an insert strip roll cartridge (26) for storing an insert strip roll (28), transport and affixing elements (26, 30) for conveying the insert strip (24) from the cartridge to the application element and affixing it against the adhesive tape to form a handle, and a holding structure (13) supporting a system (32) for cutting the insert strip.

27 Claims, 7 Drawing Sheets

(52) U.S. Cl.
CPC ..... *B65H 35/0026* (2013.01); *B65H 35/0033* (2013.01); *B65H 35/0086* (2013.01); *B65H 2301/516* (2013.01); *B65H 2301/5153* (2013.01); *B65H 2301/5154* (2013.01); *B65H 2301/515323* (2013.01); *B65H 2701/1864* (2013.01)

(58) Field of Classification Search
CPC .. B65H 2301/516; B65H 2301/515323; B65B 51/06; B65B 61/14
See application file for complete search history.

(56) References Cited

U.S. PATENT DOCUMENTS

| | | | | |
|---|---|---|---|---|
| 4,097,328 | A * | 6/1978 | Urushizaki | B65H 35/0033 156/523 |
| 4,804,437 | A * | 2/1989 | Tirtoprodjo | B65H 35/0033 156/523 |
| 4,836,352 | A | 6/1989 | Tateno et al. | |
| 4,869,769 | A | 9/1989 | DiRusso, Jr. et al. | |
| 5,079,900 | A | 1/1992 | Pinckney et al. | |
| 5,081,817 | A | 1/1992 | Nesbitt | |
| 5,145,108 | A | 9/1992 | Pinckney et al. | |
| 6,159,328 | A | 12/2000 | Gaikoski et al. | |
| 6,234,230 | B1 | 5/2001 | Petitjean | |
| 6,323,782 | B1 | 11/2001 | Stephens et al. | |
| 6,895,241 | B2 | 5/2005 | Hara | |
| 9,868,556 | B2 | 1/2018 | Le Rigoleur | |
| 2002/0080030 | A1 | 6/2002 | Inomata | |
| 2003/0138147 | A1 | 7/2003 | Ongkojoyo | |
| 2004/0076544 | A1 | 4/2004 | Dao | |
| 2006/0043298 | A1 | 3/2006 | Kawase et al. | |
| 2006/0098842 | A1 | 5/2006 | Levine | |
| 2006/0152339 | A1 | 7/2006 | Mercier et al. | |
| 2007/0145973 | A1 | 6/2007 | Bertozzi et al. | |
| 2008/0135179 | A1 | 6/2008 | Bedard | |
| 2009/0084504 | A1 | 4/2009 | Lam | |
| 2013/0048218 | A1 | 2/2013 | Lam | |
| 2013/0119129 | A1 | 5/2013 | Amdahl et al. | |
| 2013/0248425 | A1 | 9/2013 | Kunnen | |
| 2015/0112887 | A1 | 4/2015 | Camp | |
| 2015/0193732 | A1 | 7/2015 | Bouzit-Benbernou | |
| 2015/0217890 | A1 | 8/2015 | Le Rigoleur | |
| 2018/0002050 | A1 | 1/2018 | Le Rigoleur | |

FOREIGN PATENT DOCUMENTS

| | | | |
|---|---|---|---|
| FR | 2 851 360 | A1 | 8/2004 |
| WO | 88/03897 | A1 | 6/1988 |
| WO | 2004/064581 | A1 | 8/2004 |
| WO | 2013/170316 | A1 | 11/2013 |

OTHER PUBLICATIONS

European Search Report, dated Jun. 20, 2014, for European Application No. 14 29 0016, 2 pages.
International Search Report, dated Apr. 5, 2016, for International Application No. PCT/EP2016/051263, 3 pages.
International Search Report, dated Apr. 29, 2016, for International Application No. PCT/EP2015/066581, 3 pages.
Written Opinion of the International Searching Authority, dated Apr. 5, 2016, for International Application No. PCT/EP2016/051263, 5 pages.
Written Opinion of the International Searching Authority, dated Apr. 29, 2016, for International Application No. PCT/EP2015/066581, 5 pages.
First Examination Report for European Patent Application No. 15741164.6 dated Dec. 18, 2018.

* cited by examiner

HAND-HELD HANDLE DISPENSER

FIELD OF THE INVENTION

The present invention relates to the sealing of packages, cartons or parcels, and more particularly to a hand-held handle dispenser for forming a handle for carrying these packages.

RELATED ART

Current hand-held adhesive tape dispensers, commonly used for parcel wrapping) and closure, do not provide the ability for the user to add a handle to the parcel being closed. To add a handle to the parcel, a user has to place an "external" pre-manufactured handle, or some other "external" ad-hoc handle.

Such a solution requires different pre-manufactured handle models to fit with different parcel sizes. This creates logistics and storage difficulties, in addition to a second separate step for affixing the pre-manufactured handle following on the first step for wrapping and closing the parcel.

Another solution is to use a specific box with prepositioned holes made as handles. Such a solution suffers drawbacks. Indeed, customers often prefer to avoid holes in the package to secure the integrity of the content and so that the interior of the parcel cannot be seem. Moreover, the creation of these holes is an additional cost and may be the cause of a deterioration of the parcel.

SUMMARY

Embodiments of the invention overcome one or more of the above drawbacks. In summary, a handle distributor is incorporated in a hand-held adhesive tape dispenser to constitute a hand-held handle dispenser for affixing both tape and handles.

By locating the handle distributor on the hand-held adhesive tape dispenser, there is no need to search for and to choose an "external" handle from a selection of "external" pre-manufactured handles of different sizes. The handle is added to a fully closed parcel without the need for holes/openings in the parcel, and it reduces significantly the cost of using such external pre-manufactured handles. Moreover, the user can place the handle where it is most appropriate with regards to the parcel and its contents.

Another object of the invention is to give the user the ability to make handles of various lengths depending on the parcel size and shape. Such a capability is fulfilled according to embodiments of the invention by the provision of a continuous roll for feeding handles. So, it is another object of the invention to provide the ability to cut the continuous roll at the user's will with a mechanism both efficient and compact enough to fit within the hand-held tape dispenser.

One particular advantage of the embodiments of the invention is to allow the user to apply handles with only one hand as well as to ensure during the affixing of the insert strip onto the adhesive tape that the translation speeds of the adhesive tape and of the insert strip are identical so as to avoid any crinkling of the insert strip, which may eventually result in jamming the dispenser.

To this end, in at least one embodiment of the invention a hand-held handle dispenser comprises: a main frame having a handle, an adhesive tape roll provided at a rear side of the main frame for delivering an adhesive tape, an application element provided at the front side of the main frame for applying the adhesive tape onto a parcel and a cutting blade for cutting the adhesive tape, characterized in that it further comprises:

- an insert strip roll cartridge for storing an insert strip roll
- transport and affixing elements for conveying the insert strip from said cartridge to said application element and affixing it against the adhesive tape to form a handle, and
- a holding structure supporting a system for cutting said insert strip.

In at least one embodiment, a hand-held handle dispenser further comprises a revolution cutter rotating around a cutter axis for stopping the dispensing from said insert strip roll by cutting said insert strip.

According to another aspect, said revolution cutter comprises a blade designed and positioned with an angle compared to the surface of said insert strip so that said blade enters in contact with said insert strip on the side edge of said insert strip when said revolution cutter is rotated for cutting said insert strip.

Preferably, the angle between said blade and the insert strip surface is increased at the end of the blade which first enters in contact with the insert strip.

In a preferred embodiment, said revolution cutter comprises a blade with a helical shape and whose helix angle has a value comprised between 5 degrees and 30 degrees.

Advantageously, at the end of said blade where the helical cutter enters in contact with the insert strip, the increase of the helix angle has a value comprised between 10 degrees and 25 degrees.

In at least one embodiment, said insert strip is supported vertically by the upper surface of said holding structure in the vicinity of said application element and that a counter-form is carved into said holding structure so that said blade can fully penetrate into said holding structure when said revolution cutter is rotated.

Preferably, said counter-form comprises at its entrance external and internal edges and the distance between the external edge and the internal edge of the entrance of said counter-form is comprised between 1 mm and 10 mm.

In a preferred embodiment, the distance between said blade and a primary support edge is comprised between 0.1 mm and 3 mm, where said primary support edge is one of said external edge or said internal edge.

In at least another embodiment, said cutter axis is direct maintained on said holding structure.

In at least one embodiment, the rotation of said revolution cutter results from the translation of a toothed rack interacting with a gear fixedly attached to the end of said cutter axis.

In a preferred embodiment, a cutter rib is fixedly attached to said toothed rack or preferably is part of said toothed rack, cutter rib on which the user pushes to translate said toothed rack.

Preferably, a strip deviator cooperates with a tape application guide for guiding the leading edge of said insert strip towards the bottom area of said application element.

In a preferred embodiment, the side of the insert strip roll, which adheres to the tape, is printed with advertising information.

In at least one embodiment, said transport and affixing elements comprise a pulling roller continuously in contact with said insert strip for pulling said insert strip towards the adhesive surface of the adhesive tape when said pulling roller enters in contact with said adhesive tape roll, which then drives the rotation of said pulling roller.

According to at least another embodiment, said insert strip roll cartridge is mobile in rotation around a cartridge rotation axis and in that said pulling roller enters in contact with said adhesive tape roll when said insert strip roll cartridge is pushed upward by the user.

Preferably, said cartridge rotation axis is the same component as said cutter axis.

Preferably, the pulling roller is made of material with a high friction coefficient.

Additionally, said pulling roller has a surface profile made of grooves.

Advantageously, the insert strip roll is formed by a thin strip of paper approximately 45 mm wide with a non-printed side coated by a thin film of plastic or a thin film of foam of same dimensions.

According to at least one embodiment, said insert strip roll cartridge further includes a cartridge rib, which serves as a reference body for the user thumb for easily pushing upward said insert strip roll cartridge.

Advantageously, said cartridge rib is the same component as said cutter rib.

According to at least another embodiment, said transport and affixing elements comprise a pulling roller continuously in contact with said insert strip for pulling said insert strip towards the adhesive surface of the adhesive tape when said pulling roller is rotated by the user via a rotating knob.

Preferably, said insert strip is guided by said insert strip roll cartridge, whose inner width is slightly larger than the inset strip width.

Various embodiment also concern a method for dispensing a handle with the above hand-held handle dispenser comprising:

- closing the parcel with a first adhesive tape,
- affixing a second adhesive tape on the parcel to fasten a first side of the handle onto the parcel,
- dispensing the insert strip,
- automatically affixing the insert strip onto the second adhesive tape by bringing said insert strip in contact with the second adhesive tape,
- continuing the automatic affixing said insert strip onto said second adhesive tape by pulling said second adhesive tape out of the hand-held tape dispenser,
- stopping the affixing of said insert strip by rotating a revolution cutter, and
- resuming the affixing of the second adhesive tape on the parcel to fasten the second side of the handle onto the parcel.

In a particular embodiment, dispensing the insert strip is performed by rotating said rotating knob.

In another embodiment, dispensing the insert strip is performed by pushing said insert strip roll cartridge upward causing said pulling roller to enter in contact with said adhesive tape roll.

Advantageously, the affixing of the second adhesive tape on the parcel is made onto a determined length of the first adhesive tape already used for closing the parcel.

Preferably, said insert strip roll is loaded into said insert strip roll cartridge so that, when the insert strip passes under said revolution cutter, the internal side of the insert strip faces said revolution cutter.

BRIEF DESCRIPTION OF THE DRAWINGS

Other aspects, features and advantages of the present teachings will become clearer to those skilled in the art upon review of the following description of the invention in conjunction with the accompanying drawings.

DETAILED DESCRIPTION OF EMBODIMENTS

The hand-held handle dispenser according to the embodiments of the invention not only operates as a hand-held adhesive tape dispenser commonly used for parcel wrapping and closure, but also provides the ability for the user to add a handle to the parcel being closed. To this end, it is proposed to create, within a standard adhesive tape, which is generally used for closing parcels and provided by a hand-held adhesive tape dispenser, a non-adhesive zone within the length of this adhesive tape by attaching on the adhesive part of the tape an insert strip provided from a handle distributor incorporated in this hand-held adhesive tape dispenser.

The handle is made of three parts:

- a first side of the handle made of adhesive tape for adhering upstream onto the parcel and coming from the hand-held adhesive tape dispenser,
- a middle non-adhesive zone created by affixing the insert strip onto the adhesive tape, and
- a second side of the handle made of adhesive tape for adhering downstream onto the parcel and coming from the hand-held adhesive tape dispenser. Therefore, the user can use the same hand-held tool for both affixing the tape for closing the parcel and for affixing the handle in a seamless operation.

Figure 1:
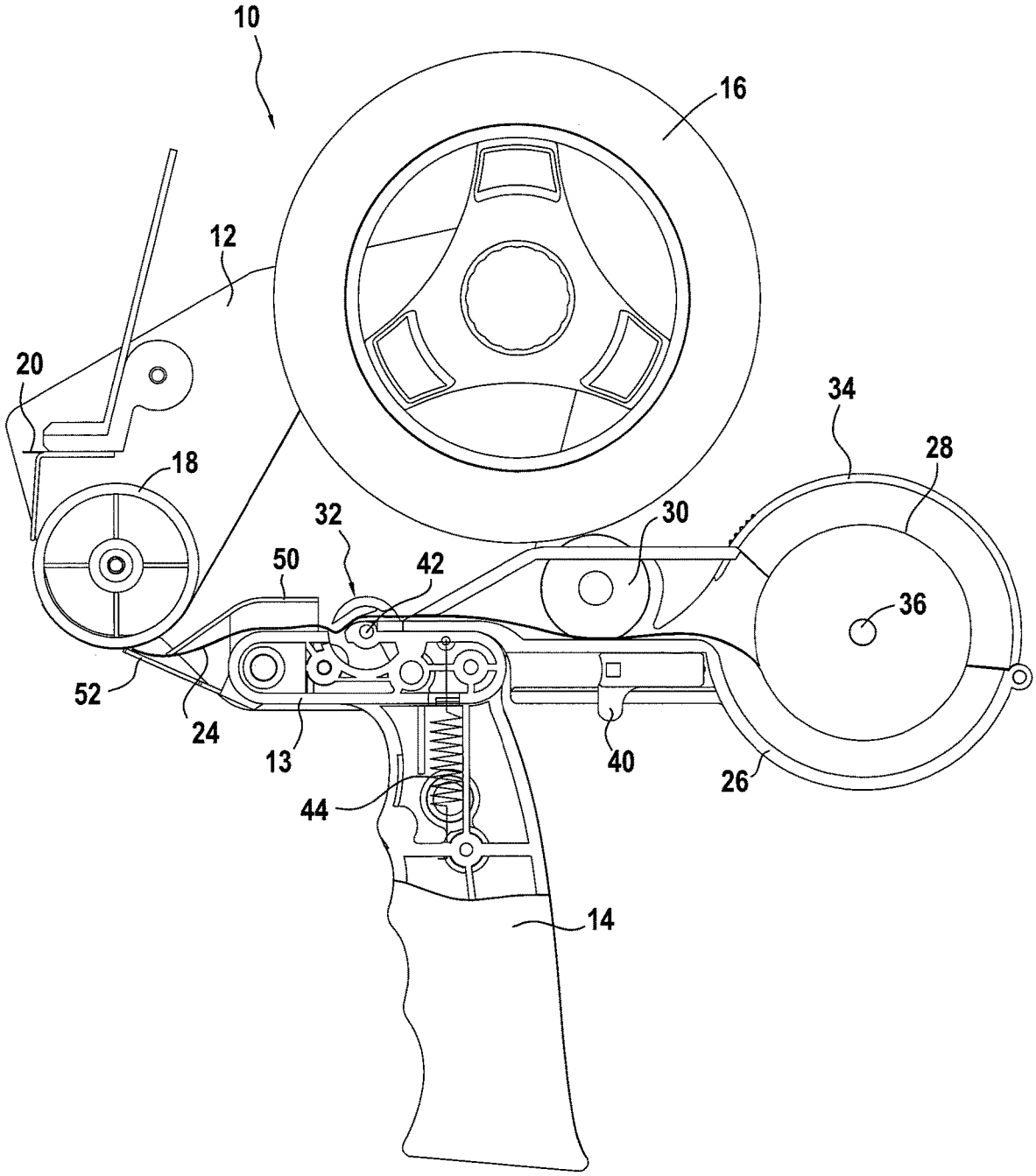
FIG. 1 shows an embodiment of a hand-held handle dispenser according to the invention in which the insert strip is dispensed from a roll via a pulling roller.

FIG. 1 illustrates a preferred embodiment of a hand-held handle dispense according to the invention.

As a standard hand-held adhesive tape dispenser, the hand-held handle dispenser 10 of the invention essentially comprises a main frame or body 12 having a handle 14, an adhesive tape roll 16 provided at the rear side of the main frame, and application element such as a roller 18 provided at the front side of the main frame and a cutting blade 20 for cutting the adhesive tape. According to the invention, such a dispenser also includes elements for dispensing and affixing the insert strip 24 on the tape, and a system 32 for cutting (elements for stopping the affixing) of the insert strip 24 supported by a holding structure 13.

Preferably, the holding structure 13 is part of the tape dispenser handle 14 and is the top part of the tape dispenser handle 14. In an alternative embodiment, the holding structure 13 and the handle 14 are constitutive of separate parts, the handle 14 being fixedly mounted under the holding structure 13.

The elements for dispensing and affixing the insert strip comprise an insert strip roll cartridge 26 for storing a strip roll and guiding the insert strip 24 from the storing area to the affixing area, and transport means such as a pulling roller 30 for conveying the insert strip 24 from the cartridge storing area to the application roller 18. In the vicinity of the affixing area, near the application roller 18, the insert strip 24 is supported vertically by the upper surface of the holding structure 13. The insert strip 24 is dispensed from the insert strip roll 28 stored in the insert strip roll cartridge 26, thus providing a continuous insert strip. The width of the insert strip roll is approximately the same as the adhesive tape, which it is to be used with. The inner width of the insert strip roll cartridge 26 is slightly larger than the insert strip width so that it can guide the insert strip from the cartridge storing area to the application roller 18 without blocking it due to too high a friction.

As illustrated, a strip deviator 50 is included in the hand-held adhesive tape dispenser. This strip deviator 50 is added to compensate for the upward pointing of the insert strip 24 described above and due to the form memory of the roll. The upward pointing of the leading edge of the insert strip 24 may cause an inappropriate adhesion of the insert strip on the tape. The strip deviator 50 cooperates with the tape application guide 52 for guiding the leading edge of the insert strip 24 towards the bottom area of the application roller 18.

The cutting system 32 (i.e., elements for stopping the affixing of the insert strip) comprises a helical cutter 302, whose action, when operated by the user of the hand-held tape dispenser, results in the cutting the continuous insert strip dispensed from the roll. Such a roll allows a provision for a large reserve for dispensing insert strips. It also allows the user to define the exact handle length that he may want.

Preferably, the insert strip roll can be obtained from a roll of paper measuring between 44 mm and 49 mm wide so as to provide a good coverage of standard adhesive tape typically having a width of 50 mm. The side of the insert strip roll, which adheres to the tape, can be printed with some advertising information. This advertising information could be seen through the tape when this one is transparent or partially transparent. Another possibility for the insert strip roll is to use a thin strip of plastic or a thin strip of foam approximately 45 mm wide instead of a roll of paper. The invention can be readily adapted by those killed in the art to other standard adhesive tape widths such as 75 mm.

For dispensing handles with the hand-held tape dispenser, an insert strip roll 28 must be loaded into the insert strip roll cartridge 26. A new insert strip roll 28 will have to be loaded each time the previous one has been fully used or needs to be changed. The loading of the insert strip roll 26 is performed by opening the cover 34 of the insert strip roll cartridge 26, by inserting the insert strip roll 28 on the axis 36, and by manually inserting the leading edge of insert strip under the pulling roller 30. Then, the leading edge of insert strip must be driven further along its path by the pulling roller 30.

In one embodiment of the invention, the initiation for the creation of a new handle is semi-automatic and requires only one of the user's hands. This embodiment is represented on FIG. 1. While the user is in the process of affixing the adhesive tape onto a parcel, the dispensing of the insert strip operates as follows. First, the user pushes the insert strip roll cartridge 26 upward. The bottom surface of the strip roll cartridge 26 includes a cartridge rib 40. This cartridge rib serves as a reference body so that the user thumb can easily stop and rest on it when the user decides to push upward the strip roll cartridge 26. The insert strip roll cartridge 26 is maintained by and is mobile in rotation around the cartridge rotation axis 42. When the user pushes the insert strip roll cartridge 26 upward, the insert strip roll cartridge 26 rotates around the cartridge rotation axis 42 and the pulling roller 30 enters in contact with the adhesive tape roll 16. As the user continues pulling the adhesive tape while affixing it onto the parcel, the rotation of the adhesive tape roll 16 makes the pulling roller 30 rotate. As the pulling roller 30 rotates, it pulls the insert strip 24 towards the adhesive surface of the adhesive tape and makes the insert strip roll 28 rotate. Thus the insert strip 24 is transported towards the adhesive tape. During its transportation, the insert strip 24 is guided by the inner sides of the strip roll cartridge 26. The action of advancing an insert strip towards the adhesive tape results in adhering the insert strip to the adhesive tape and therefore in creating on the adhesive tape of a zone where the adhesive tape has no longer the ability to adhere to the parcel, thus creating a zone free of adhesive, which can be used as a "handle". This non-adhesive zone also means that the "handle" does not adhere to the user's hand while carrying the parcel. Once affixed onto the adhesive tape, the insert strip 24 is pulled by the adhesive tape itself, as well as being pulled by the pulling roller 30 as long as the user keeps pushing upward the whole insert strip roll dispenser. It must be noticed that these two pulling mechanisms are exactly synchronized as they are both resulting from the rotation of the adhesive tape roll 16. The rotation of the pulling roller 30 moves the insert strip the same distance as the adhesive tape is moved. Therefore, this movement synchronization avoids any crinkling of the insert strip, which could be due to different translation speeds of the adhesive tape and of the insert strip, and which may eventually result in jamming the dispenser.

Advantageously, the pulling roller 30 is made of material with a high friction coefficient so as to be efficiently driven ire rotation by the adhesive tape roll 16 on one hand and so as to efficiently pull the insert strip 24 on the other hand. A preferred material for the pulling roller 30 is rubber. Preferably, the contact surface of the pulling roller 30 is profiled in order to increase its friction efficiency. A preferred surface profile for the pulling roller 30 is made of grooves with a triangular profile or a square profile.

Once the dispensing of the insert strip has been initiated and the insert strip has started being affixed onto the adhesive tape, the user can stop pushing upward the insert strip roll cartridge 26. The insert strip roll cartridge 26 returns to its rest down position for example via a spring mechanism 44. Then, the insert strip 24 is pulled only by the adhesive tape itself: the pulling roller 30 is not in contact anymore with the adhesive tape roll 16 and does not pull the insert strip 24 anymore. However, because of the synchronization of the translation speeds of the adhesive tape and of the insert strip described above, the user may maintain the insert strip roll cartridge 26 pushed upward as long as he desires without any risk of crinkling the insert strip.

Figure 2:
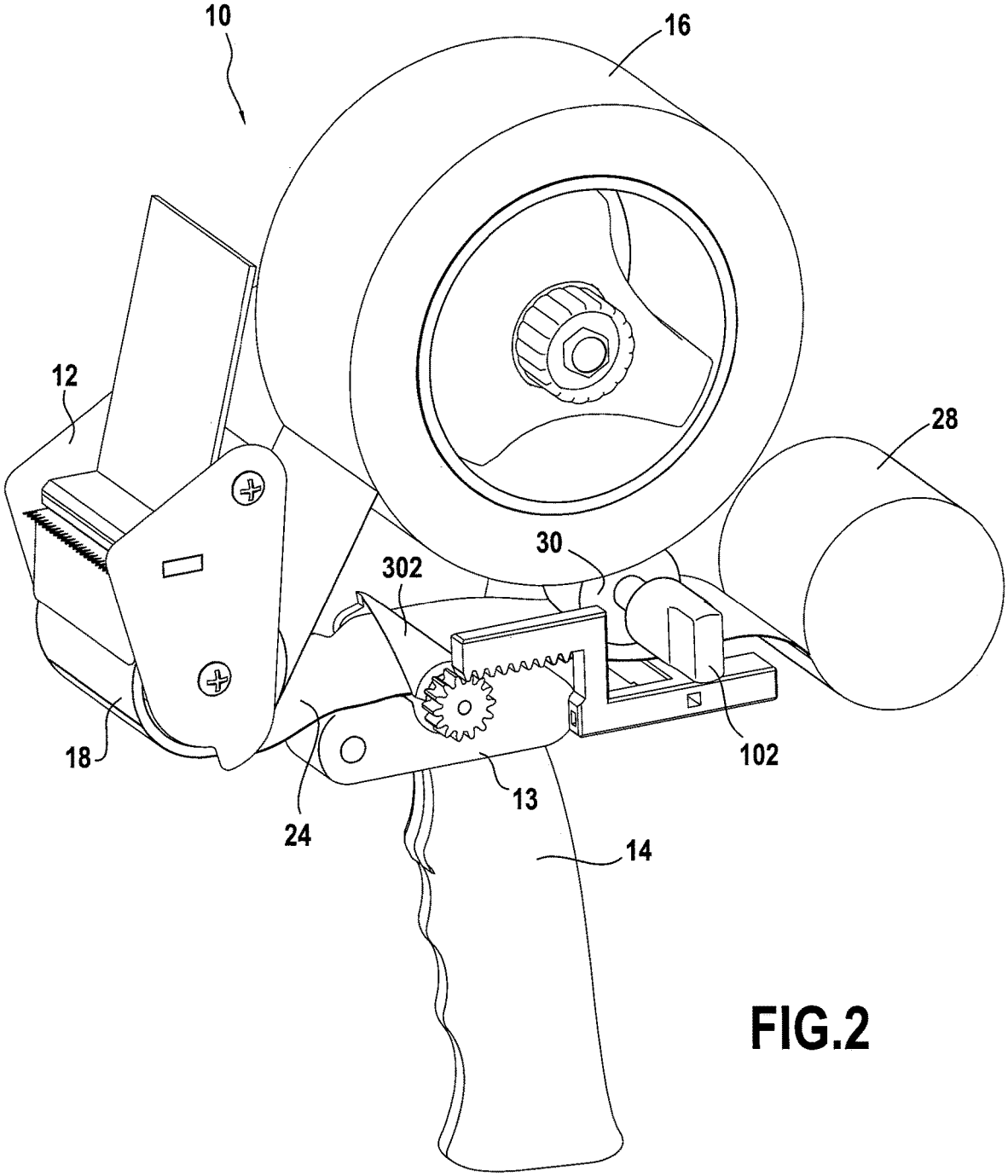
FIG. 2 shows a hand-held handle dispenser with the rotating knob for the initial loading of the insert strip roll and for manually dispensing the insert strip.

However, in another embodiment illustrated in FIG. 2, a rotating knob 102 is rotated clockwise by the user for rotating the pulling roller 30 and thus pulling forward the insert strip 24. During this pulling of the insert strip 24 by the pulling roller 30, the insert strip is guided by the inner sides of the strip roll cartridge 26. The user needs to pull the insert strip 24 enough so that its leading edge exits the insert strip roll cartridge 26 and is therefore visible. Preferably, the insert strip 24 is pulled almost near the adhesive tape in the vicinity of the application roller 18 so that it is ready for a small additional pulling when an insert strip needs to be affixed onto the adhesive tape.

Each time an insert strip needs to be affixed to the adhesive tape, the user rotates clockwise the rotating knob 102 with one hand until the leading edge of the insert strip adheres to the adhesive tape. Then, the user continues unrolling the adhesive tape by pulling with his other hand holding the tape dispenser handle 14. As the insert strip 24 adheres to the adhesive tape, it is pulled by the adhesive tape, therefore creating a zone on the adhesive tape where the adhesive tape has no longer the ability to adhere to the parcel, thus creating a zone free of adhesive, which can be used as a "handle". This non-adhesive zone also means that the "handle" does not adhere to the user's hand while carrying the parcel. It can be noted that in this embodiment, the initiation for the creation of a new handle requires both the hands of the user: one for rotating the rotating knob 102 and one for holding the tape dispenser handle 14 for pulling on it.

It can be noted that in the above embodiment of the invention, as the initiation for the creation of a new handle requires only one of the user's hands, preferably both the handle 19 of the tape dispenser and the cartridge rib 40 serving as a reference body for the user thumb are designed so as to be symmetric with respect to the main plane of symmetry of the hand-held tape dispenser, so that the tape dispenser can be seamlessly used by a left-handed user as well as a by right-handed user.

Regardless of the embodiment (manual or semi-automatic), once the adequate length of handle has been affixed onto the tape, the dispensing of the continuous insert strip needs to be stopped by cutting the insert strip at the user's will. A straightforward method for cutting the continuous strip dispensed from the insert strip roll is to use a straight knife. In a previous embodiment described in the non-published application EP2 902 352, a presser actionable by the trigger is used to raise the insert strip roll towards a straight knife in order to cut the insert strip. However, the effectiveness of the cutting of the insert strip by simply raising the insert strip towards the knife tends to be random. There are several issues with the use of such a mechanism. The pressure of the straight knife on the insert strip is applied simultaneously on the whole width of the insert strip. As a result, the pressure on each point of the width of the insert strip is limited. The initiation of the cutting is difficult and the straight knife often tends to only indenting the insert strip, rather than efficiently cutting it. Generally, the user continues pulling the adhesive tape while pressing on the straight knife for cutting the insert strip. As a result, the insert strip is pulled with the adhesive tape and tends to slip over the straight knife. Overall, depending on a multiplicity of factors including the pressure applied by the user on the straight knife or the pulling action by the user on the adhesive tape or the blade sharpness of the straight knife, the insert strip may sometimes slip over the straight knife and eventually be torn rather than be cut efficiently.

One way to improve the cutting efficiency is to use a guillotine shaped knife, i.e. a knife whose blade is designed and positioned with an angle compared to the insert strip surface. With such a guillotine shaped knife, the cut would be improved because it would be initiated on the side edge of the insert strip so that all the pressure applied by the user for cutting the insert strip would be applied on only one point: the point on the side edge of the insert strip where the guillotine shaped knife enters in contact with the insert strip. However, such a guillotine shaped blade requires too much space to be fit into the standard hand-held adhesive tape dispenser available on the market.

In order to minimize the space occupied by the system for cutting the insert strip so that it can be fit into the standard hand-held adhesive tape dispenser available on the market and in order to ensure an efficient cutting of the insert strip, a revolution cutter is used to perform the cutting of the insert strip. Such a revolution cutter is shaped so as to be inscribed on a surface of revolution rotating around a central axis and comprising a blade whose edge is on the surface of revolution. In the preferred embodiment described below, the revolution cutter is helical.

Figure 3:
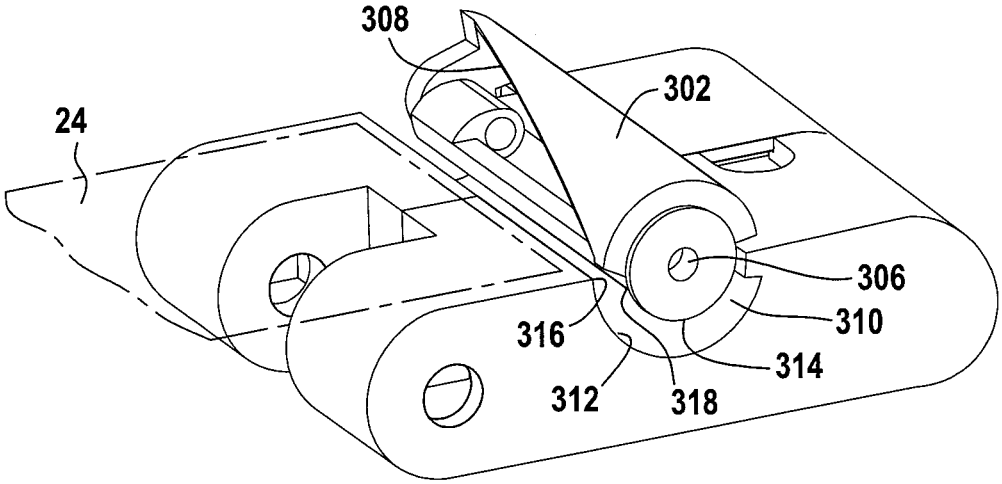
FIG. 3 shows a variant of the embodiment of a hand-held handle dispenser of FIG. 1 in which the insert strip is cut using a helical cutter and an associated counter-form.

The FIG. 3 represents a cutting system according to the invention. The helical cutter 302 is shaped within a cylinder with a circular base, and it is directly maintained on the holding structure 13 via the cutter axis 306. The helical cutter 302 comprises a blade 308, whose edge is designed according to a helix inscribed on the cylinder. The helix angle $\alpha$ illustrated on FIG. 4A and defined in a standard way as the angle between the cylinder axis and the straight line obtained by unraveling the helix onto a plane, has preferably a value comprised between 5 degrees and 30 degrees.

Figure 4A:
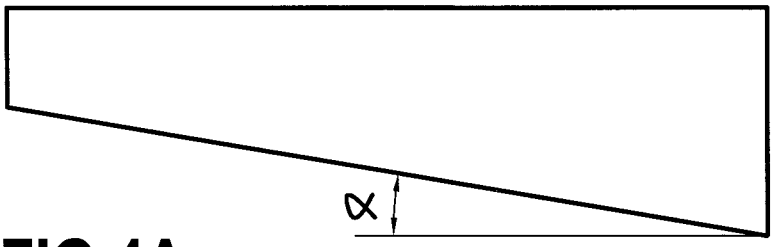
FIG. 4A illustrates the definition of the helix angle as the angle between the cylinder axis and the straight line obtained by unraveling the helix onto a plane for a blade with a pure helical shape.
Figure 4B:
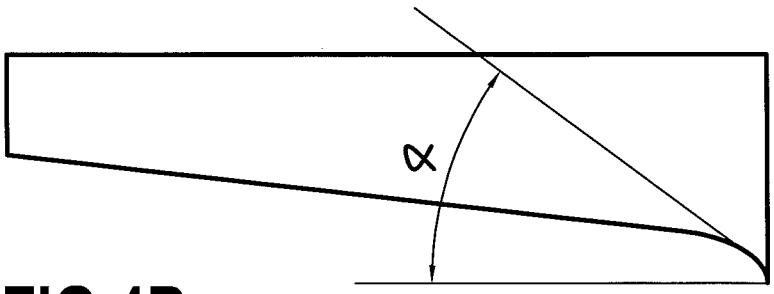
FIG. 4B illustrates an optimized helical blade unraveled onto a plane with a local increase of the helix angle at the end of the blade.

Due to mechanical dimensions constraints, the angle between the helical blade and the insert strip surface tends to be too small. In order to increase the angle between the blade and the insert strip surface, at the point on the side edge of the insert strip where the helical cutter enters in contact with the insert strip, the shape of the blade is locally changed at the end of the blade which first enters in contact with the insert strip. FIGS. 4A and 4B illustrate the change from a blade with a pure helical shape (FIG. 4A) to an optimized helical blade with a local increase of the helix angle at the end of the blade (FIG. 4B). The increase of the helix angle at the end of the blade where the helical cutter enters in contact with the insert strip has preferably a value comprised between 10 degrees and 25 degrees.

The local optimization of the shape of the blade at the end which first enters in contact with the insert strip, which is described above and which leads to an increase of the angle between the blade and the insert strip surface, is applicable to any revolution cutter and is not limited to a helical shape.

The helical cutter 302 rotates around the cutter axis 306 so that the blade, when it enters in contact with the insert strip 24, cuts the insert strip 24. A counter-form volume 310 is carved into the holding structure 13 so that the helical blade 308 can fully penetrate into the holding structure when the revolution cutter 302 is rotated, thus allowing the insert strip 24 to be cut along its whole width. A preferred counter-form volume 310 is defined by an external surface 312 inscribed on an external cylinder and an internal surface 314 inscribed on an internal cylinder, both cylinders having the same axis of revolution, which is the cutter axis 306. However, any counter-form volume is possible as long as it allows the helical blade 308 to fully penetrate into the holding structure when the revolution cutter 302 is rotated and ensures that the mechanical structure of the holding structure 13 is sturdy enough. The critical elements of the counter-form are the external edge 316 and the internal edge 318 of the entrance of the counter-form. The counter-form is designed and carved into the holding structure 13 so that the holding structure thus carved supports the insert strip 24, i.e. prevents it from moving vertically, while it is cut by the helical blade 308 and therefore ensure the cut quality by the helical blade 308. The distance between the external edge 316 and the internal edge 318 is comprised between 1 mm and 10 mm.

One of the counter-form edges, either the external edge 316 or the internal edge 318, must be chosen as the primary support edge for the cutting process. The cut quality is all the more effective as the distance between the helical blade 308 and the primary support edge is limited. The distance between the helical blade 308 and the primary support edge should be comprised typically between 0.1 mm and 3 mm, preferably 0.5 mm. Preferably, the primary support edge is the external edge 316.

The cutting system characteristics of the invention described above allow use of a wide variety of materials for the blade 308 and helical cutter 302. Metals can of course be used, but plastics as well as materials for 3D printing can also be used or other materials known in the art. The helical cutter can also be an assembly of two different materials for the blade and the core structure of the helical cutter, for example metal for the blade and plastic for the core structure of the helical cutter.

As seen above, the counter-form 310 ensures that the insert strip 24 is maintained vertically while it is cut by the helical blade 308. At the same time (returning to FIG. 1), to ensure the quality of the cut, the insert strip 24 is maintained also horizontally on the left side by the tape on which it is affixed and the insert strip is maintained horizontally on the right side by the pulling roller 30.

As mentioned previously, blade shapes other than a helix are also possible. However, a helical shape is preferred as it is a good compromise between industrial constraints and cut efficiency.

Preferably, for industrial reasons as well as for ergonomic reasons, the cutter axis 306 is the same component as the cartridge rotating axis 42. The fact that both these axis are identical enables a cutting of the insert strip when the insert strip cartridge is in the up position as well as when the insert strip cartridge is resting in the down position.

The primary goal of the helical cutter is to initiate the cut on the side edge of the insert strip so that all the pressure applied by the user for cutting the insert strip is applied on only one point, i.e. the point on the side edge of the insert strip where the helical cutter enters in contact with the insert strip. Therefore, the cutting can be efficiently initiated by focusing all the pressure applied by the user for cutting the insert strip on that particular point rather than diluting the pressure applied by the user on the whole width of the insert strip as in the case of the straight knife.

Figure 5:
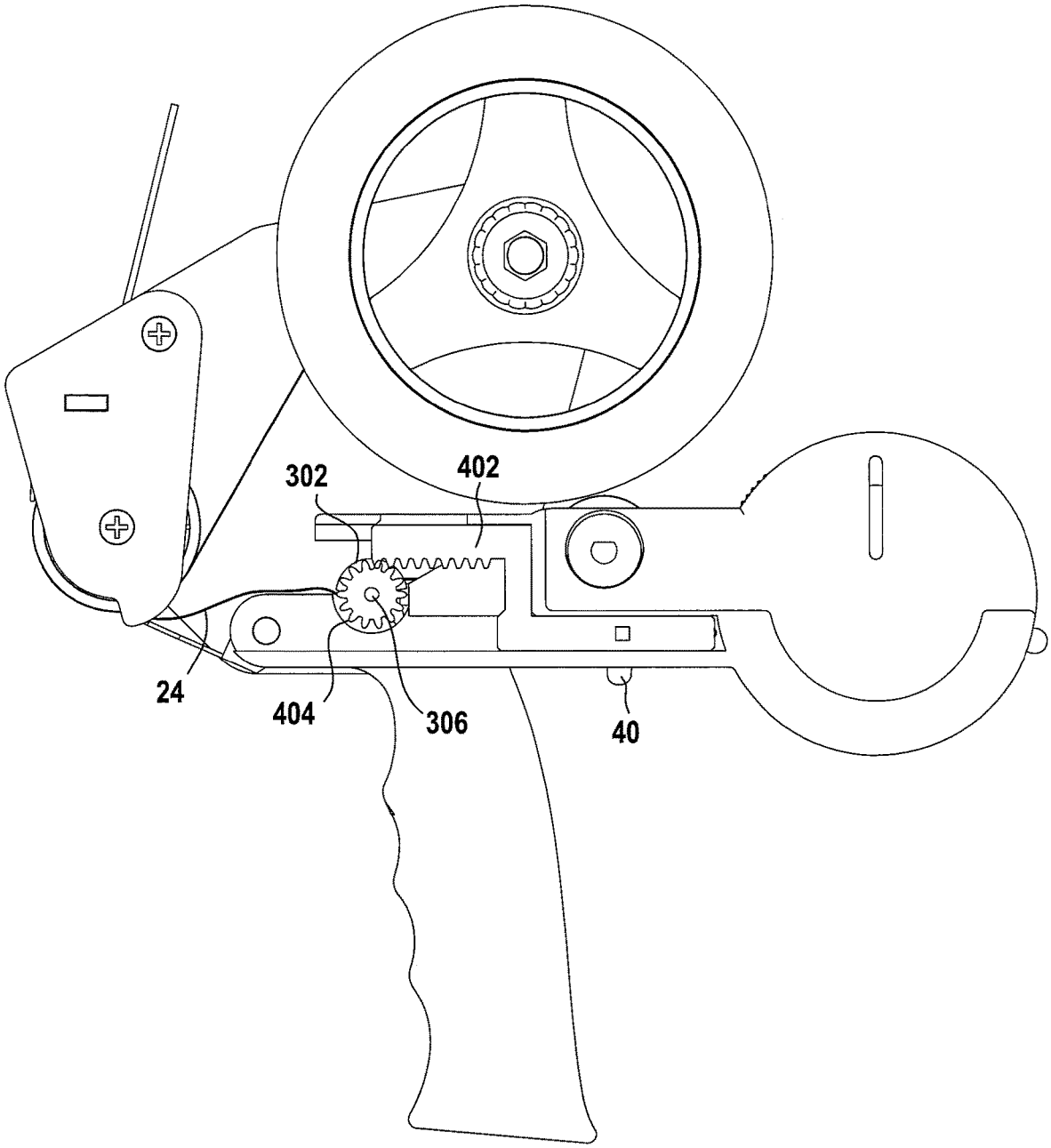
FIG. 5 shows an embodiment of the hand-held handle dispenser of FIG. 1 in which the helical cutter is activated by a translating toothed rack.

FIG. 5 represents the preferred system for activating the helical cutter 302 for cutting an insert strip. The preferred embodiment for carrying out the rotation of the helical cutter 302 in order to cut the insert strip 24, is to transform the translation of a toothed rack 402 into the rotation of the cutter axis 306 via the interaction of the toothed rack 402 with a gear 404 fixedly attached to the end of the cutter axis 306. This activation of the helical cutter 302 is performed manually by the user who pushes horizontally on a cutter rib, which for industrial reasons as well as for ergonomic reasons is the same component as the cartridge rib 40. The cutter rib 40 is fixedly attached to the toothed rack 402 or preferably is part of the toothed rack 402. Therefore this horizontal push by the user leads a forward horizontal translation of the toothed rack 402. As the toothed rack 402 is positioned above the gear 404, a forward horizontal translation of the toothed rack 402 leads a forward rotation of the cutter axis 306, which brings the helical cutter 302 onto the insert strip 24 for cutting it.

Once the cut of the inset strip roll is performed, the user releases the cutter rib 40 and the toothed rack 402 automatically returns to its rest position for example via the spring mechanism 406. The return of the toothed rack 402 to its rest position leads to the backward rotation of the gear 404 and of the cutter axis 306, therefore leading to the ascent of the helical cutter 302. Thus, the helical cutter 302 returns to its rest position, freeing the path for the insert strip, which can be pushed thereafter on its path under the helical cutter.

Other systems known in the art for activating the rotation of the helical cutter 302 can be applied by those skilled in the art. In particular, rather than pushing a toothed rack leading to a forward rotation of the helical cutter 302, the user could pull backward a differently designed toothed rack.

In positioning this toothed rack 40 under the gear 404, the backward movement of this toothed rack would lead a forward rotation of the cutter axis 306 and the subsequent cutting of the insert strip.

One particular issue regarding the feeding of the insert strip is that it may get stuffed into the counter-form 310. This issue can be visualized on FIG. 3. After the insert strip 24 has been cut by the helical cutter 302, the leading edge of the insert strip 24, where the cut has taken place, lays near the counter-form 310. When a new handle is required, the insert strip 24 is pushed towards the adhesive tape and the leading edge of the insert strip 24 is pushed over the counter-form 310. During this passage over the counter-form 310, the leading edge of the insert strip 24 may be caught by the counter-form 310 and may end up being stuffed into the counter-form 310. Similarly, after the initial loading of the into the insert strip roll cartridge, the insert strip is engaged into the transport elements for conveying it towards the adhesive tape. As the insert strip is pushed towards the adhesive tape, it passes over the counter-form 310. During this passage over the counter-form 310, the leading edge of the insert strip may be caught by the counter-form 310 and may end up being stuffed into the counter-form 310.

In order to prevent the leading edge of the insert strip 24 from being caught by the counter-form 310 and from ending up being stuffed into the counter-form 310, FIG. 2 shows how the insert strip roll 28 should be loaded into the insert strip roll cartridge. During the loading of the insert strip roll 28, this one should be oriented so that the leading edge of the insert strip points upward. The segment of the insert strip roll located between the insert strip roll 28 and the pulling roller 30, which is part of transport elements for conveying the insert strip towards the adhesive tape, tends to point upward. Thus, the form memory of the roll can be used during the conveying of the insert strip through the transport elements for conveying it towards the adhesive tape. When the leading edge of the insert strip is pushed over the counter-form 310, the leading edge of the insert strip tends to point upward due to the form memory of the roll, and therefore is not caught by the counter-form 310.

An insert strip unrolled from an insert strip roll can be characterized as having an internal side, which points towards the center of the insert strip roll when the insert strip is still rolled up, and having an external side, which points away from the center of the insert strip roll when the insert strip is still rolled up. As a general rule, the insert strip roll 28 should be loaded into the insert strip roll cartridge so that, when the insert strip passes under the revolution cutter 302, the internal side of the insert strip faces the revolution cutter 302. Thanks to the form memory of the roll, the leading edge of the insert strip points towards the revolution cutter 302 and therefore is not caught by the counter-form 310.

Figure 6B:
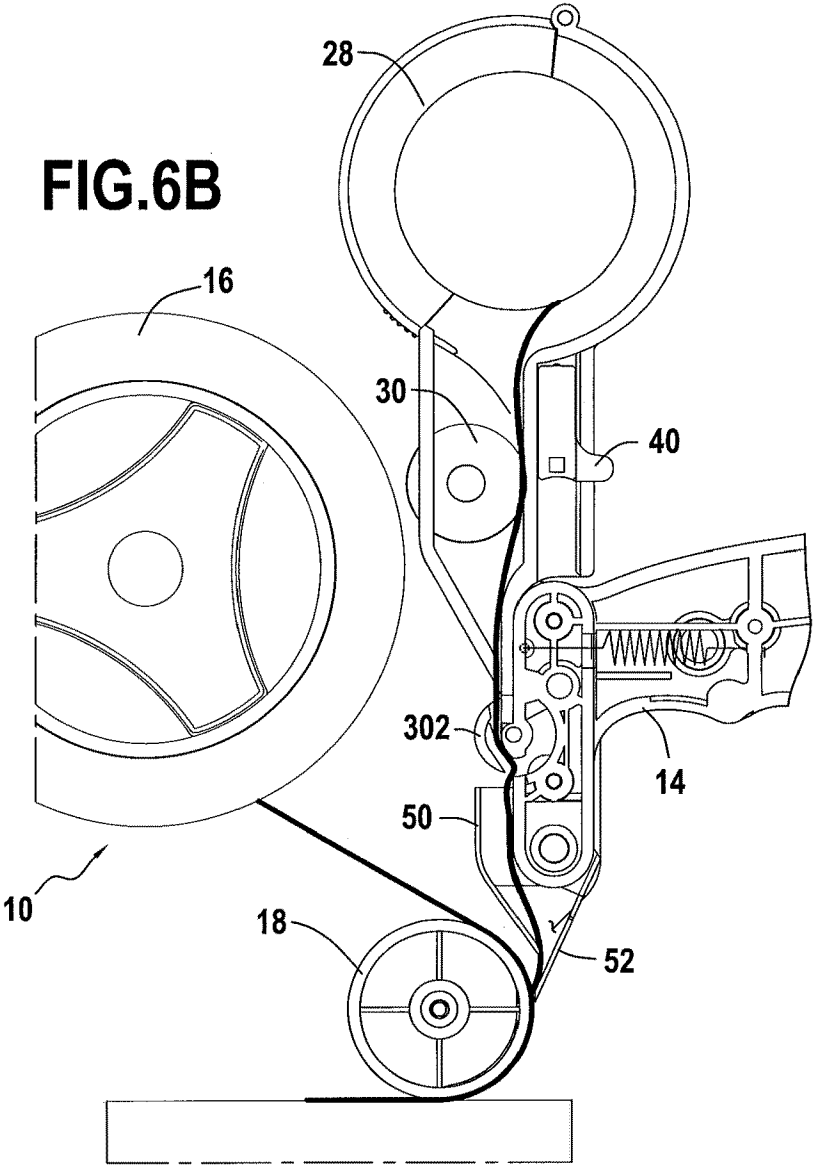
FIGS. 6A to 6F illustrate different tape and insert strip positions during operating of the hand-held handle dispenser of the invention.
Figure 6A:
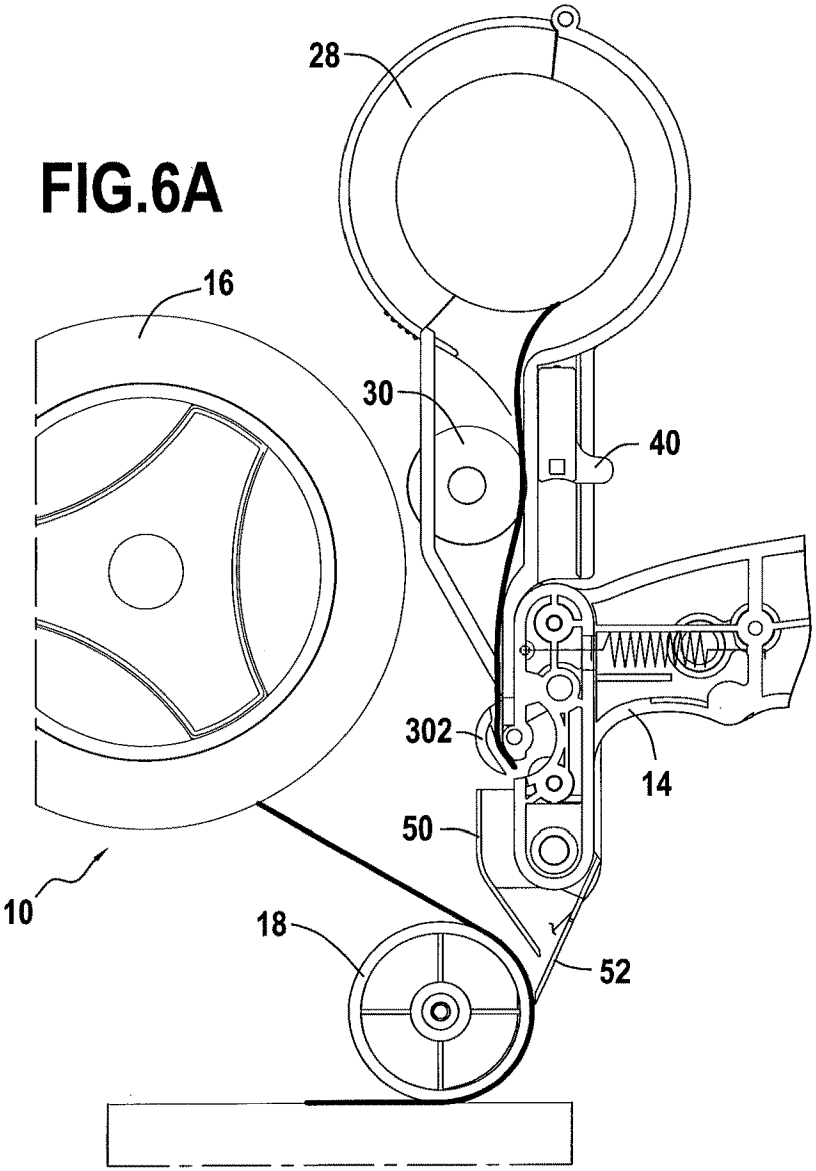
Figure 6D:
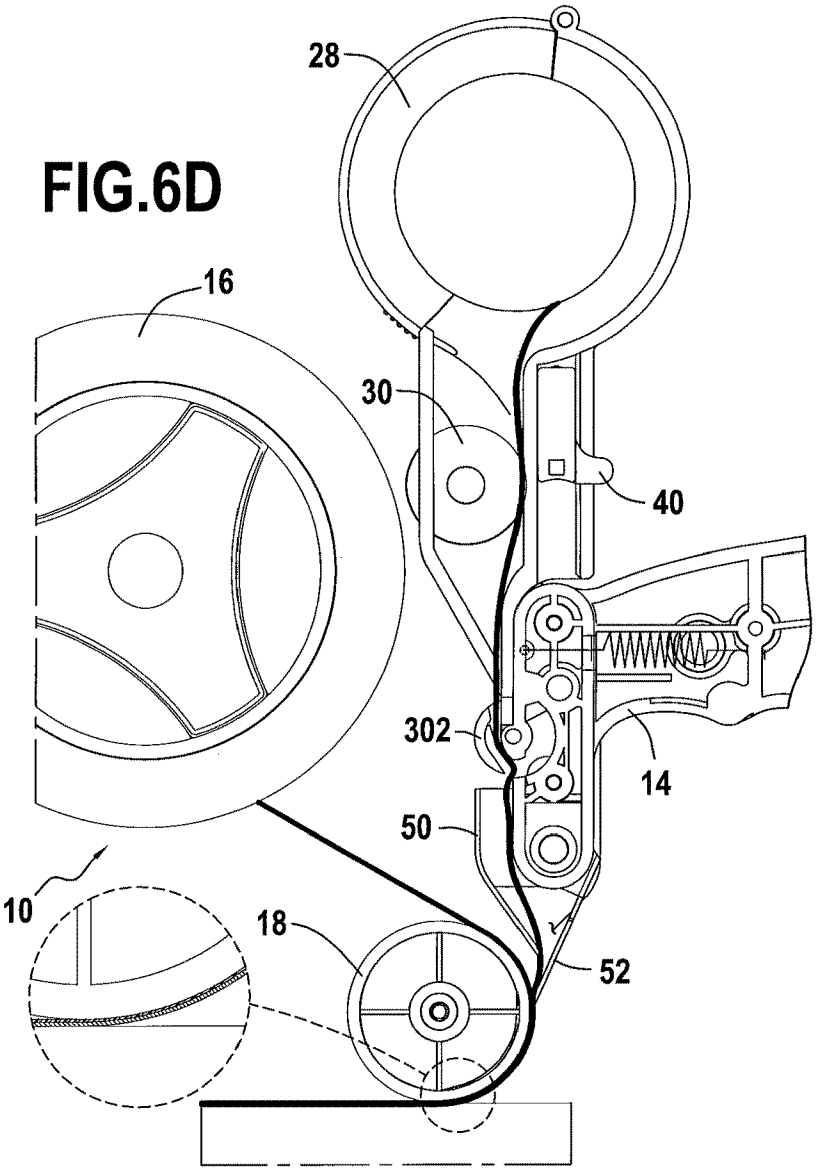
Figure 6C:
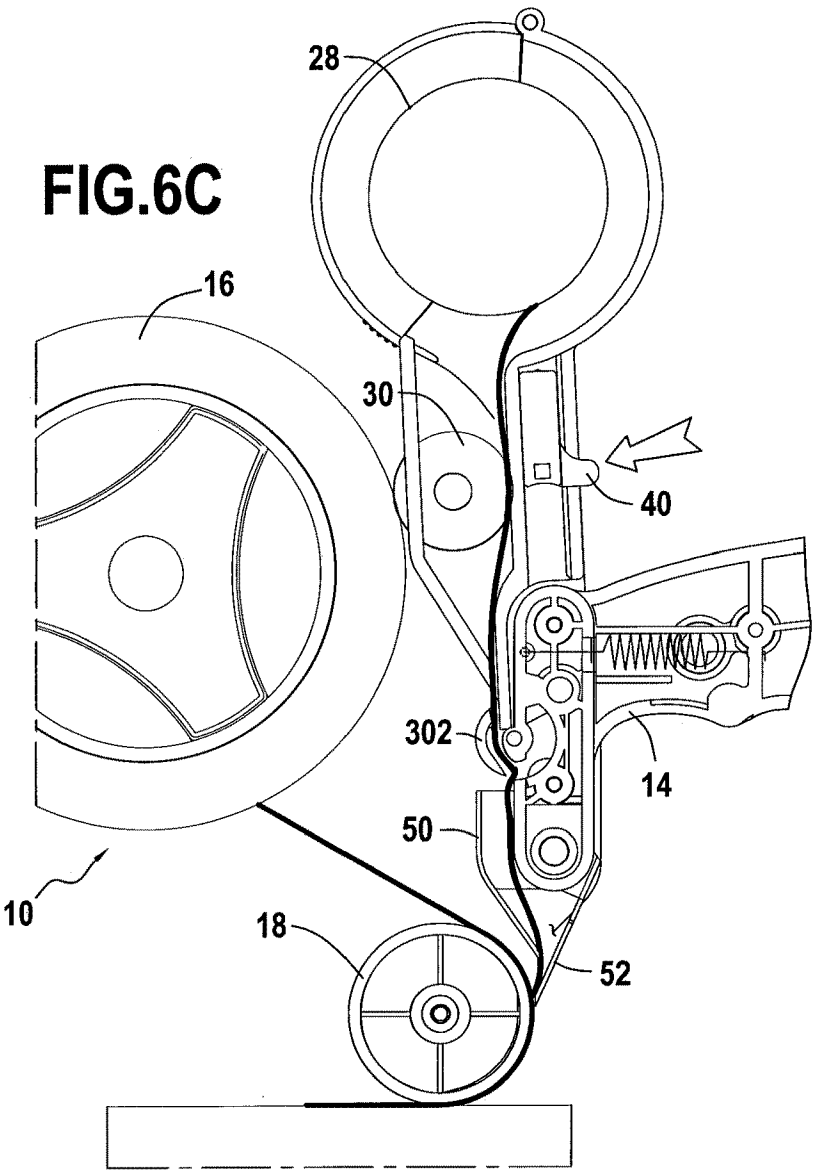
Figure 6F:
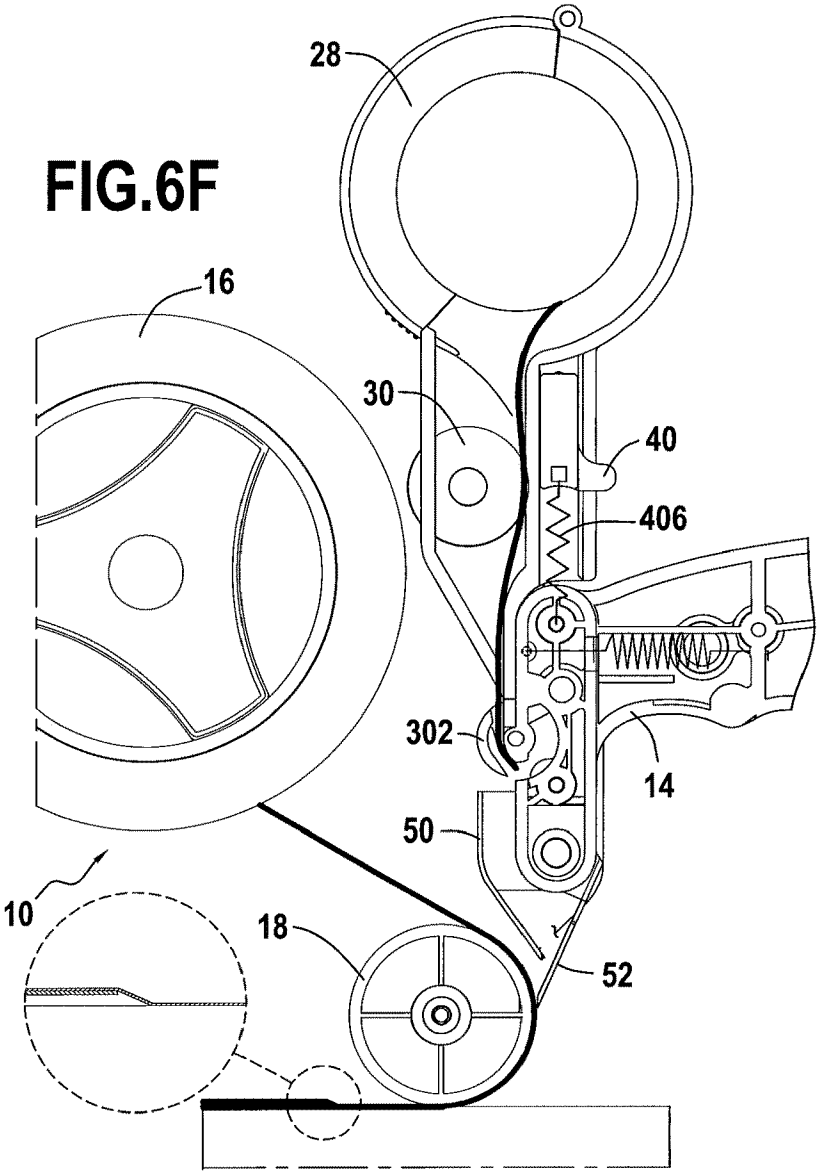
Figure 6E:
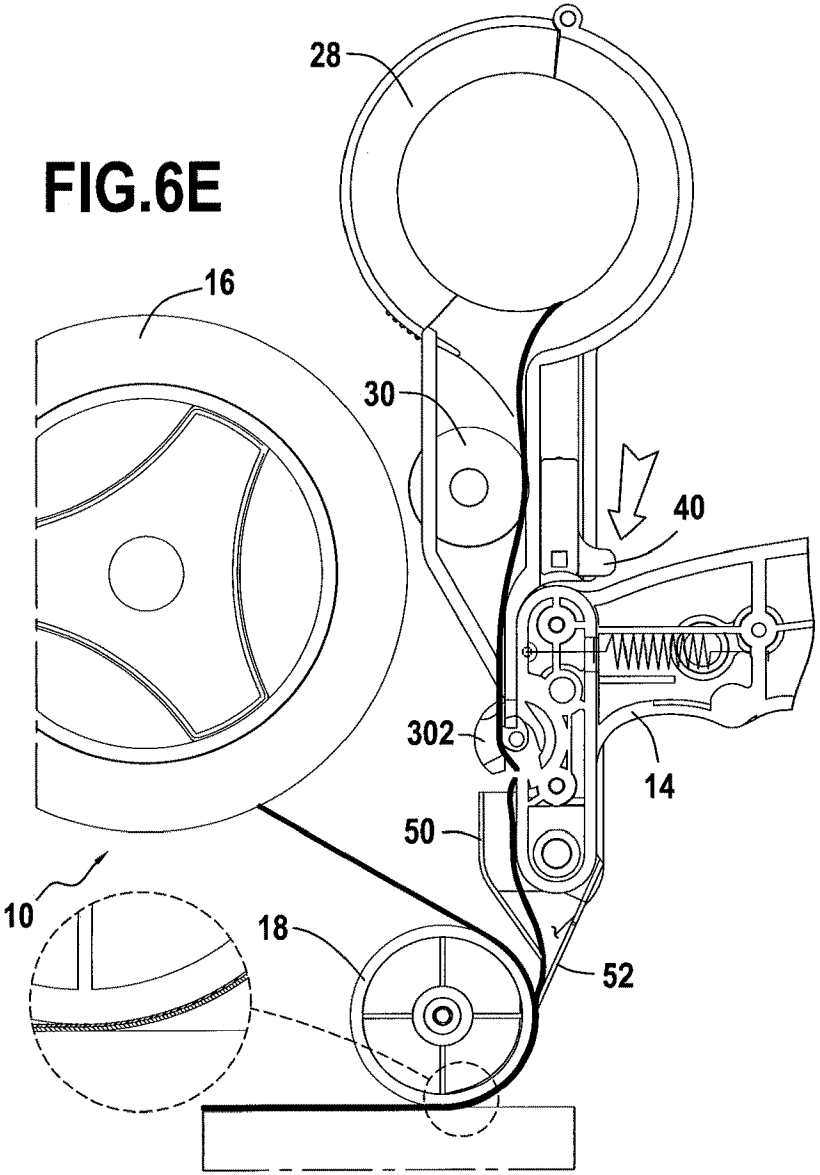

Regardless of the embodiment, the operation for dispensing a handle with the hand-held handle dispenser of the invention can be summarized as follows with reference to FIGS. 6A to 6F:

The parcel must first be closed in a standard way with a first adhesive tape, then the steps for adding the handle take place and comprise:

affixing a second adhesive tape onto the parcel for fastening the first side of the handle onto the parcel, preferably onto the first adhesive tape already used for closing the parcel or onto a piece of adhesive tape already affixed onto the parcel (FIG. 6A), dispensing the insert strip at the user's will (FIG. 6B), automatically affixing the insert strip onto the second adhesive tape being dispensed by bringing the insert strip in contact with the adhesive surface of the tape (FIG. 6C)—during this affixing process the strip deviator 50 cooperates with the tape application guide 52 for guiding the leading edge of the insert strip 24 towards the bottom area of said application roller 18, continuing the automatic affixing the insert strip onto the second adhesive tape by pulling the adhesive tape out of the hand-held tape dispenser (FIG. 6D), stopping the affixing of the insert strip by pushing the cutter rib 40 driving the rotation of the revolution cutter 302 (FIG. 6E), and resuming the affixing the second adhesive tape on the parcel for fastening the second side of the handle onto the parcel, preferably onto the adhesive tape already used for closing the parcel or onto a piece of adhesive tape already affixed onto the parcel (FIG. 6F).

Depending on the embodiment, dispensing the insert strip 24 is performed either by manually rotating with one hand the rotating knob 102 leading the rotation of the pulling roller 30, while holding the tape dispenser handle 14 with the other hand, or by pushing, typically with the thumb of the same hand holding the tape dispenser handle 14, the insert strip roll cartridge 26 upward causing the pulling roller 30 to enter in contact with the adhesive tape roll 16.

It is recommended that the non-adhesive parts of the handle be preceded and terminated by adhesive tape segments with a length measuring at least 15 cm and adhering to opposite sides of the parcel. The non-adhesive parts of the handle should start on one of the top edges of the parcel and should end on the opposite edge of the parcel. Furthermore, for better durability, it is recommended that the adhesive pares of the handle adhere onto adhesive tape already used for closing the parcel.

Large parcels may require more than one handle. Two handles can be placed on either side of the parcel and perpendicularly to the longest edge. This enables the parcel to be carried by one or two persons depending on its size and weight.

It must be noted that the different elements for dispensing the insert strip can be provided as handle distributor kits for upgrading standard hand-held adhesive tape dispensers in the field or for producing brand new combo tape and handle dispensers, and therefore benefiting from the experience curve and economies of scale of current adhesive tape dispenser. Alternatively, the handle distributor can be integrated onto adhesive tape dispenser currently distributed on the market place allowing the following possibilities such as integrating the handle distributor within the production line of adhesive tape dispenser.

Although the invention has been described with respect to preferred embodiments thereof, it will be understood by those skilled in the art that the foregoing and various other changes omissions and deviations in the form and detail thereof may be made without departing from the spirit and scope of this invention.

The invention claimed is:

1. A hand-held handle dispenser comprising: a main frame having a handle, an adhesive tape roll provided on a rear side of the main frame for delivering an adhesive tape, an application element provided on the front side of the main frame to apply the adhesive tape onto a parcel and a cutting blade to cut the adhesive tape, wherein said hand-held handle dispenser further comprises an insert strip roll cartridge that stores an insert strip roll, transport and affixing elements to convey the insert strip from said cartridge to said application element and affix the insert strip against the adhesive tape to form a handle, and a holding structure supporting a system to cut said insert strip, wherein said hand-held handle dispenser comprises a revolution cutter rotating around a cutter axis operable to stop the dispensing from said insert strip roll by cutting said insert strip.

2. The hand-held handle dispenser according to claim 1, wherein said revolution cutter comprises a blade designed and positioned with an angle compared to the surface of said insert strip so that said blade enters in contact with said insert strip on the side edge of said insert strip when said revolution cutter is rotated for cutting said insert strip.

3. The hand-held handle dispenser according to claim 2, wherein the angle between said blade and the insert strip surface is increased at the end of the blade which first enters in contact with the insert strip.

4. The hand-held handle dispenser according to claim 1, wherein said revolution cutter comprises said blade with a helical shape and whose helix angle has a value comprised between 5 degrees and 30 degrees.

5. The hand-held handle dispenser according to claim 4, wherein, at the end of said blade where the helical cutter enters in contact with the insert strip, the increase of the helix angle has a value comprised between 10 degrees and 25 degrees.

6. The hand-held handle dispenser according to claim 1, wherein said insert strip is supported vertically by the upper surface of said holding structure in the vicinity of said application element and said holding structure includes a counter-form positioned so that said blade can fully penetrate into said holding structure when said revolution cutter is rotated.

7. The hand-held handle dispenser according to claim 6, wherein said counter-form has an entrance and at the entrance an external edge and an internal edge and the distance between said external and internal edges of the entrance of said counter-form is comprised between 1 mm and 10 mm.

8. The hand-held handle dispenser according to claim 7, wherein a smallest distance between said blade and a primary support edge as the blade rotates is between 0.1 mm and 3 mm, where said primary support edge is one of said external edge or said internal edge.

9. The hand-held handle dispenser according to claim 1, wherein said cutter axis is directly maintained on said holding structure.

10. The hand-held handle dispenser according to claim 1, wherein the rotation of said revolution cutter results from the translation of a toothed rack interacting with a gear fixedly attached to the end of said cutter axis.

11. The hand-held handle dispenser according to claim 10, wherein a cutter rib is fixedly attached to said toothed rack, cutter rib on which a user pushes to translate said toothed rack.

12. The hand-held handle dispenser according to claim 1, wherein said insert strip roll is formed by a thin strip of material approximately 45 mm wide with a non-printed side coated by a thin film of plastic or a thin film of foam of same dimensions.

13. The hand-held handle dispenser according to claim 1, wherein a strip deviator cooperates with a tape application guide for guiding the leading edge of said insert strip towards the bottom area of said application element.

14. The hand-held handle dispenser according to claim 1, wherein the side of the insert strip roll, which adheres to the tape, is printed with advertising information.

15. The hand-held handle dispenser according to claim 1, wherein said transport and affixing elements comprise a pulling roller continuously in contact with said insert strip for pulling said insert strip towards the adhesive surface of the adhesive tape when said pulling roller enters in contact with said adhesive tape roll, which then drives the rotation of said pulling roller.

16. The hand-held handle dispenser according to claim 15, wherein said insert strip roll cartridge is mobile in rotation around a cartridge rotation axis and in that said pulling roller enters in contact with said adhesive tape roll when said insert strip roll cartridge is pushed upward by a user.

17. The hand-held handle dispenser according to claim 16, wherein said cartridge rotation axis is the same component as a cutter axis of a revolution cutter of said hand-held handle dispenser.

18. The hand-held handle dispenser according to claim 16, wherein said insert strip roll cartridge includes a cartridge rib, which serves as a reference body for a thumb of the user for easily pushing upward said insert strip roll cartridge.

19. The hand-held handle dispenser according to claim 18, wherein said cartridge rib is the same component as a cutter rib of a revolution cutter of said hand-held handle dispenser.

20. The hand-held handle dispenser according to claim 15, wherein said pulling roller is made of material with a high-friction coefficient.

21. The hand-held handle dispenser according to claim 15, wherein said pulling roller has a surface profile made of grooves.

22. The hand-held handle dispenser according to claim 15, wherein said insert strip is guided by said insert strip roll cartridge, whose inner width is slightly larger than the insert strip width.

23. The hand-held handle dispenser according to claim 1, wherein said transport and affixing elements comprise a pulling roller continuously in contact with said insert strip to pull said insert strip towards the adhesive surface of the adhesive tape when said pulling roller is rotated by a user via a rotating knob.

24. A method for dispensing a handle with the hand-held handle dispenser according to claim 1 comprising:

closing the parcel with a first adhesive tape;

affixing a second adhesive tape onto the parcel to fasten a first side of the handle onto the parcel;

dispensing the insert strip;

automatically affixing the insert strip onto said second adhesive tape by bringing said insert strip in contact with said second adhesive tape;

continuing the automatic affixing said insert strip onto said second adhesive tape by pulling said second adhesive tape out of the hand-held tape dispenser;

stopping the affixing of said insert strip by rotating a revolution cutter; and resuming the affixing of said second adhesive tape onto the parcel to fasten the second side of said handle onto the parcel.

25. The method according to claim 24, wherein dispensing the insert strip is performed either by rotating said rotating knob or by pushing said insert strip roll cartridge upward causing said pulling roller to enter in contact with said adhesive tape roll.

26. The method according to claim 24, wherein the affixing of said second adhesive tape on the parcel is made onto a determined length of said first adhesive tape already used for closing the parcel.

27. The method according to claim 24, further comprising loading said insert strip roll into said insert strip roll cartridge so that, when the insert strip passes under said revolution cutter, an internal side of the insert strip faces said revolution cutter.

* * * * *